US011337566B2

(12) United States Patent
Yoshida et al.

(10) Patent No.: US 11,337,566 B2
(45) Date of Patent: May 24, 2022

(54) TOILET PAPER

(71) Applicant: DAIO PAPER CORPORATION, Ehime (JP)

(72) Inventors: Shohei Yoshida, Shizuoka (JP); Noritada Tomioka, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 69 days.

(21) Appl. No.: 16/621,434

(22) PCT Filed: Jun. 26, 2018

(86) PCT No.: PCT/JP2018/024234
§ 371 (c)(1),
(2) Date: Dec. 11, 2019

(87) PCT Pub. No.: WO2019/004224
PCT Pub. Date: Jan. 3, 2019

(65) Prior Publication Data

US 2020/0375413 A1 Dec. 3, 2020

(30) Foreign Application Priority Data

Jun. 30, 2017 (JP) ..... JP2017-128580

(51) Int. Cl.
*A47K 10/16* (2006.01)
*D21H 27/00* (2006.01)
(Continued)

(52) U.S. Cl.
CPC ..... *A47K 10/16* (2013.01); *B31F 1/12* (2013.01); *D21H 27/002* (2013.01);
(Continued)

(58) Field of Classification Search
CPC ..... D21H 27/002; D21H 27/30; D21H 27/02; B31F 1/07; B31F 2201/0764;
(Continued)

(56) References Cited

U.S. PATENT DOCUMENTS 4,339,088 A * 7/1982 Niedermeyer ..... A47K 10/16 101/32
5,036,758 A * 8/1991 Kobayashi ..... D06C 15/02 101/28
(Continued)

FOREIGN PATENT DOCUMENTS

EP 0379767 A1 * 8/1990 ..... D06C 15/08
JP H06-028951 4/1994
(Continued)

OTHER PUBLICATIONS

Machine Translation of JP 2005287725 A (Year: 2005).*
(Continued)

*Primary Examiner* — Jose A Fortuna
(74) *Attorney, Agent, or Firm* — IPUSA, PLLC

(57) ABSTRACT

Toilet paper includes at least two sheets on which embossments are formed and that are joined together in a nested manner. The area of a top part of an embossed protrusion of each of the embossments is between 0.8 $mm^2$ and 1.5 $mm^2$, and the area percentage of top parts of embossed protrusions of the embossments is between 5% and 10%.

6 Claims, 7 Drawing Sheets

(51) Int. Cl.
*D21H 27/02* (2006.01)
*D21H 27/30* (2006.01)
*B31F 1/12* (2006.01)
*B31F 1/07* (2006.01)

(52) U.S. Cl.
CPC ..... *D21H 27/02* (2013.01); *D21H 27/30* (2013.01); *B31F 1/07* (2013.01)

(58) Field of Classification Search
CPC ..... B31F 2201/0735; B31F 1/12; B32B 2250/26; B32B 2555/00; B32B 2262/067; A47K 10/16
See application file for complete search history.

(56) References Cited

U.S. PATENT DOCUMENTS 5,620,776 A * 4/1997 Schulz ..... B31F 1/07 162/109
6,153,053 A * 11/2000 Harper ..... D21H 15/02 162/109
6,245,414 B1 * 6/2001 Biagiotti ..... B31F 1/07 428/172
6,277,467 B1 * 8/2001 Dwiggins ..... B31F 1/07 162/109
6,827,819 B2 * 12/2004 Dwiggins ..... B31F 1/07 162/123
6,896,768 B2 * 5/2005 Dwiggins ..... B31F 1/07 162/123
6,916,403 B2 * 7/2005 Basler ..... B31F 1/07 162/117
8,973,267 B2 * 3/2015 Gelli ..... B23C 3/32 29/895.3
10,464,254 B2 * 11/2019 Gelli ..... B29C 59/04
2003/0021953 A1 1/2003 Graff
2009/0114347 A1 * 5/2009 Gelli ..... B23C 5/04 156/446
2009/0226670 A1 * 9/2009 Schutz ..... D21H 27/02 428/154
2009/0311481 A1 * 12/2009 Morin ..... D21H 27/40 428/172
2010/0043989 A1 * 2/2010 Shannon ..... D21H 27/38 162/112
2010/0297281 A1 * 11/2010 McNeil ..... B31F 1/07 425/373
2011/0111180 A1 * 5/2011 Sauter ..... B31F 1/07 428/172
2013/0220151 A1 * 8/2013 Sauter ..... B31F 1/07 101/28
2013/0344294 A1 * 12/2013 Eilert ..... B32B 29/08 428/172
2014/0044923 A1 * 2/2014 Gelli ..... A47K 10/16 428/153
2015/0165716 A1 * 6/2015 Logiodice ..... B32B 38/06 156/535
2015/0167215 A1 * 6/2015 Manninen ..... D04H 13/00 428/132
2017/0246827 A1 * 8/2017 Stefani ..... B32B 23/04
2018/0104928 A1 * 4/2018 Dwiggins ..... B32B 3/30
2020/0011014 A1 * 1/2020 Pleyber ..... D21H 27/30
2020/0129012 A1 * 4/2020 Yoshida ..... A47K 10/16
2020/0298525 A1 * 9/2020 Dwiggins ..... B32B 7/12
2020/0375413 A1 * 12/2020 Yoshida ..... A47K 10/16

FOREIGN PATENT DOCUMENTS

JP 2005-287725 10/2005
JP 2006-280616 10/2006
JP 2006-334326 12/2006
JP 2009-528928 8/2009
JP 2011-153387 8/2011
JP 2012-183236 9/2012
JP S021532 11/2016
WO 2017/002416 1/2017

OTHER PUBLICATIONS

International Search Report dated Sep. 11, 2018 with respect to PCT/JP2018/024234 filed on Jun. 26, 2018.
Japanese Office Action for 2018-563185 dated Dec. 17, 2019.

* cited by examiner

TOILET PAPER

TECHNICAL FIELD

The present invention relates to toilet paper.

BACKGROUND ART

Known toilet paper has a structure in which multiple sheets of embossed base paper are stacked on each other.

For example, Japanese Patent No. 6,021,532 (Patent Document 1) discloses toilet paper having a laminated structure called a design laminate. A design is added to this toilet paper by bonding sheets of base paper together using an adhesive including a pigment component.

Also, Japanese Laid-Open Patent Publication No. H06-028951 (Patent Document 2) discloses toilet paper having a tip-to-tip laminated structure. In this toilet paper, top parts of two embossed pulp-like materials are bonded to each other (see FIGS. 5-7).

RELATED-ART DOCUMENTS

Patent Documents

[Patent Document 1]
Japanese Patent No. 6021532
[Patent Document 2]
Japanese Laid-Open Patent Publication No. H06-028951

DISCLOSURE OF INVENTION

Problems to be Solved by the Invention

However, with the configuration of the related-art toilet paper with a design, although the sheets of base paper can be bonded strongly to each other, it is difficult to obtain bulky toilet paper because sufficient space is not formed between the sheets of base paper. Also, with the configuration of the toilet paper having a tip-to-tip laminated structure, bulky toilet paper can be obtained because a large space is formed between the sheets of base paper. However, this toilet paper tends to be flattened easily. Thus, with the related-art configurations, it is difficult to obtain bulky toilet paper that is less likely to be flattened.

One object of the present invention is to provide bulky toilet paper that is less likely to be flattened.

Means for Solving the Problems

In an aspect of the present invention, there is provided toilet paper including at least two sheets on which embossments are formed and that are joined together in a nested manner. The area of a top part of an embossed protrusion of each of the embossments is between 0.8 $mm^2$ and 1.5 $mm^2$, and the area percentage of top parts of embossed protrusions of the embossments is between 5% and 10%.

Advantageous Effect of the Invention

An aspect of the present invention makes it possible to provide bulky toilet paper that is less likely to be flattened.

DESCRIPTION OF EMBODIMENTS

Figure 1:
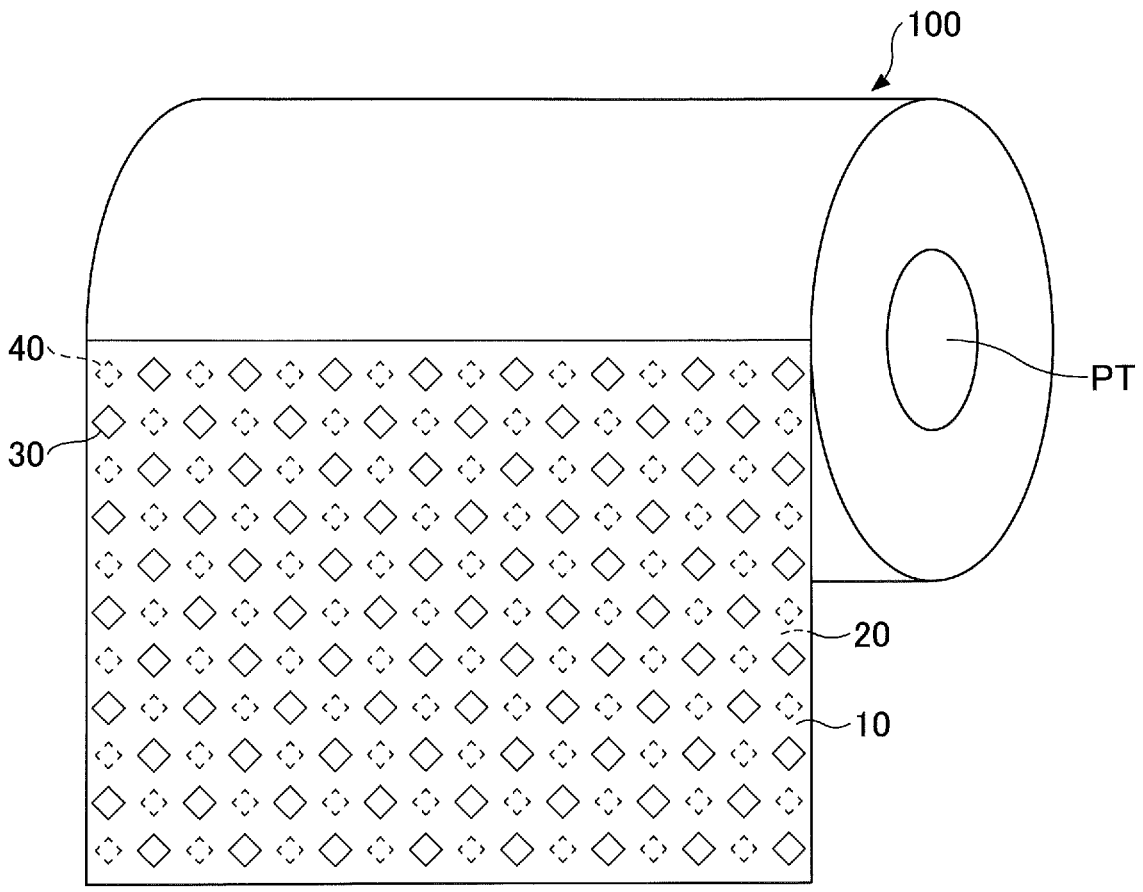
FIG. 1 is a drawing illustrating toilet paper according to an embodiment of the present invention.

According to a first aspect of the present invention, toilet paper includes at least two sheets on which embossments are formed and that are joined together in a nested manner. The area of a top part of an embossed protrusion of each of the embossments is between 0.8 $mm^2$ and 1.5 $mm^2$, and the area percentage of top parts of embossed protrusions of the embossments is between 5% and 10%.

In the present application, embossments indicate embossed protrusions and non-embossed parts surrounded by the embossed protrusions that are formed in a region (which may be hereinafter referred to as an embossed region) of a sheet on which embossing is performed. The area of the top part of the embossed protrusion indicates the area of the top part of each embossed protrusion. The area percentage of the top parts of the embossed protrusions indicates the percentage of the area of the top parts of the embossed protrusions in the area of the embossed region.

According to the first aspect of the present invention, toilet paper includes at least two sheets on which embossments are formed and that are joined together in a nested manner, the area of a top part of an embossed protrusion of each of the embossments formed in each sheet is between 0.8 $mm^2$ and 1.5 $mm^2$, and the area percentage of top parts of embossed protrusions of the embossments is between 5% and 10%. This configuration makes it possible to support the sheets by the embossed protrusions and thereby makes it possible to increase the strength in the thickness direction. Accordingly, the first aspect makes it possible to provide toilet paper that is less likely to be flattened.

Also, the first aspect makes it possible to prevent the embossed protrusions formed in the opposing sheets from interfering with each other, and makes it possible to form a space (which is hereafter referred to as a non-embossment space) where no embossed protrusion is present between the sheets. Accordingly, the first aspect makes it possible to provide bulky toilet paper that is less likely to be flattened.

Also, the first aspect makes it possible to reduce the bonding area between the embossed protrusions and the sheets and thereby makes it possible to suppress toilet paper from becoming hard (becoming inflexible) due to the presence of bonded portions between the embossed protrusions and the sheets.

In the toilet paper according to a second aspect of the present invention, the height of the embossed protrusion is between 1.0 mm and 1.7 mm. In the present application, the height of each embossed protrusion is the distance between an embossed protrusion forming surface of each sheet and the top part of the embossed protrusion.

According to the second aspect, the height of the embossed protrusion is set within the above range so that the non-embossment space formed between the sheets can be increased while maintaining the strength in the thickness direction. Accordingly, the second aspect makes it possible to provide bulky toilet paper that is less likely to be flattened.

In the toilet paper according to a third aspect of the present invention, the side surface of the embossed protrusion is inclined from the sheet toward the top part such that the area of the top part of the embossed protrusion becomes less than the area of an opening of an embossed recess corresponding to the embossed protrusion.

According to the third aspect, the side surface of the embossed protrusion is inclined such that the area of the top part of the embossed protrusion becomes less than the area of the opening of the embossed recess. This configuration makes it possible to reliably prevent the embossed protrusions formed in the opposing sheets from interfering with each other and to further increase the bulk of the toilet paper. Also, the third aspect makes it possible to reduce the bonding area between the embossed protrusions and the sheets and thereby makes it possible to further suppress toilet paper from becoming hard due to bonded portions.

In the toilet paper according to a fourth aspect of the present invention, the inclination angle of the side surface of the embossed protrusion is between 60 degrees and 80 degrees. In the present application, the inclination angle of the side surface of the embossed protrusion indicates an angle between the embossed protrusion forming surface of the sheet and the side surface of the embossed protrusion. In the fourth aspect, the inclination angle of the side surface of the embossed protrusion is set between 60 degrees and degrees. This configuration makes it possible to further suppress the toilet paper from becoming hard due to bonded portions while maintaining the bulk and the anti-flattening property of the toilet paper.

According to a fifth aspect of the present invention, under a load of a 50 gf/cm$^2$, an initial thickness of the toilet paper is greater than or equal to 0.7 mm and a compression ratio of the toilet paper is less than or equal to 60%. In the fifth aspect, the initial thickness of the toilet paper is greater than or equal to 0.7 mm and the compression ratio of the toilet paper is less than or equal to 60% under a load of a 50 gf/cm$^2$. This configuration makes it possible to reliably obtain bulky toilet paper that is less likely to be flattened.

According to a sixth aspect of the present invention, the compression strength of the toilet paper under a load of 500 gf/cm$^2$ is greater than or equal to 4.5 gf·cm/cm$^2$. In the sixth aspect, the compression strength of the toilet paper under a load of 500 gf/cm$^2$ is greater than or equal to 4.5 gf·cm/cm$^2$. This configuration makes it possible to further increase the strength of the toilet paper. Accordingly, the sixth aspect makes it possible to obtain durable toilet paper while maintaining the bulk and the anti-flattening property of the toilet paper. Toilet paper whose compression strength is greater than or equal to 4.5 gf·cm/cm$^2$ under a load of 500 gf/cm$^2$ can be readily compressed. Accordingly, the sixth aspect makes it possible to obtain soft toilet paper.

Embodiments of the present invention are described below with reference to the accompanying drawings. In the descriptions below, for ease of understanding, the same reference number is assigned to the same component or corresponding components throughout the drawings and repeated descriptions of those components may be omitted unless otherwise mentioned. Also, in the present application, the scale of components in the drawings may be different from the actual scale.

Figure 2:
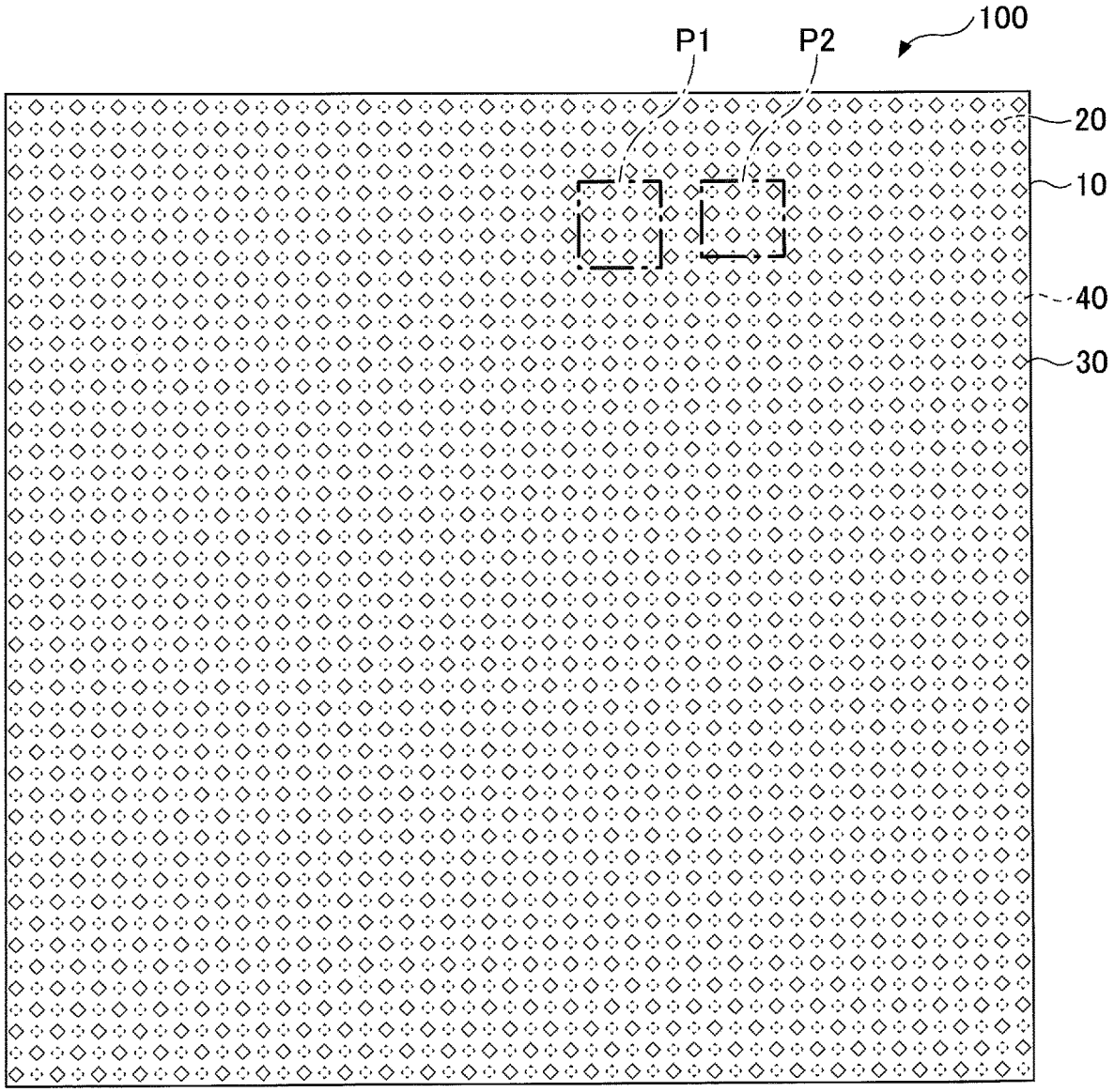
FIG. 2 is a drawing illustrating sheets of crepe paper constituting toilet paper according to an embodiment.

FIG. 1 illustrates toilet paper according to an embodiment of the present invention, and FIG. 2 illustrates sheets of crepe paper constituting toilet paper according to the present embodiment.

Toilet paper 100 illustrated in FIG. 1 is an example of toilet paper according to the present invention. The toilet paper 100 is rolled toilet paper formed by winding, around a paper tube PT, a strip of toilet paper in which perforation lines (not shown) for separation are formed at appropriate intervals. The form of toilet paper is not limited to rolled toilet paper used in the present embodiment. For example, the present invention may also be applied to stacked (pick-up or pop-up) toilet paper where toilet paper sheets are folded and stacked.

The toilet paper 100 includes crepe paper 10 and crepe paper 20. Fine wrinkles are formed on the surface of each of the crepe paper 10 and the crepe paper 20 by bringing a so-called doctor blade into contact with the surface at the exit of a dryer of a paper machine in a paper sheet making process. The crepe paper 10 and the crepe paper 20 are examples of two sheets constituting toilet paper of the present invention.

The crepe paper 10 and the crepe paper 20 are made of base paper that is made mostly from pulp. The composition of pulp of the base paper may be a normal composition of pulp used for toilet paper. For example, the proportion of pulp is 90 wt %, is preferably greater than or equal to 95 wt %, and is more preferably 100 wt %.

The pulp composition of the crepe paper 10 and the crepe paper 20 is not limited to any specific composition. For example, softwood pulp such as needle bleached kraft pulp (NBKP) or needle unbleached kraft pulp (NUKP) and hardwood pulp such as leaf bleached kraft pulp (LBKP) or leaf unbleached kraft pulp (LUKP) may be mixed at an appropriate ratio. For example, the ratio of softwood pulp to hardwood pulp may be between 30:70 and 80:20.

Also, paper having a predetermined basis weight (or paper weight in gsm) conforming to JIS P 8124 (1998) may be used for the crepe paper 10 and the crepe paper 20. As a non-limiting example, the predetermined basis weight may be in a range between 10 g/m$^2$ and 25 g/m$^2$, and is preferably in a range between 12 g/m$^2$ and 20 g/m$^2$ in view of, for example, flexibility, hydrolysis, and wiping performance of toilet paper.

Figure 3:
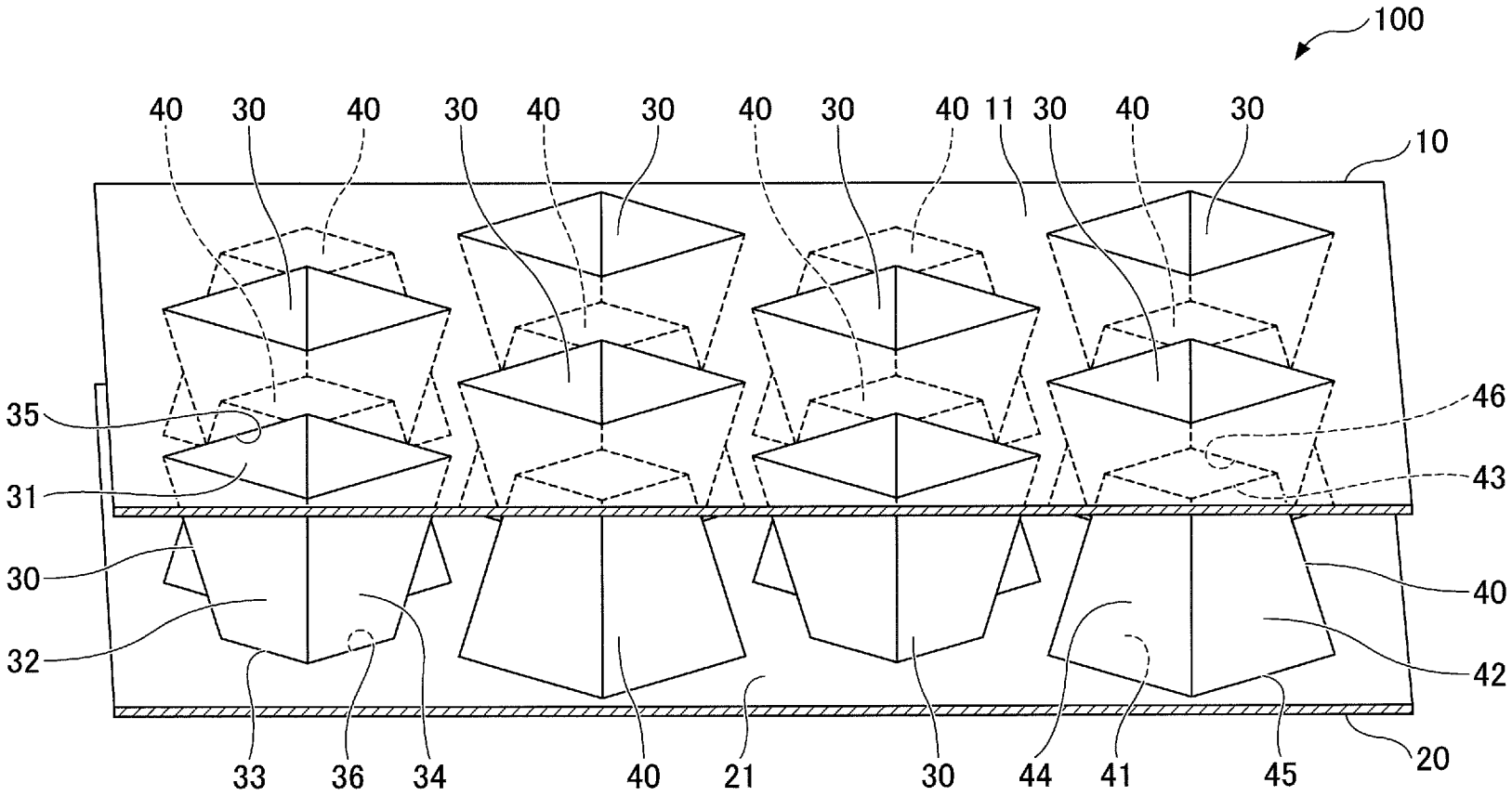
FIG. 3 is an enlarged perspective cross-sectional view of a portion (P1) of FIG. 2.
Figure 4:
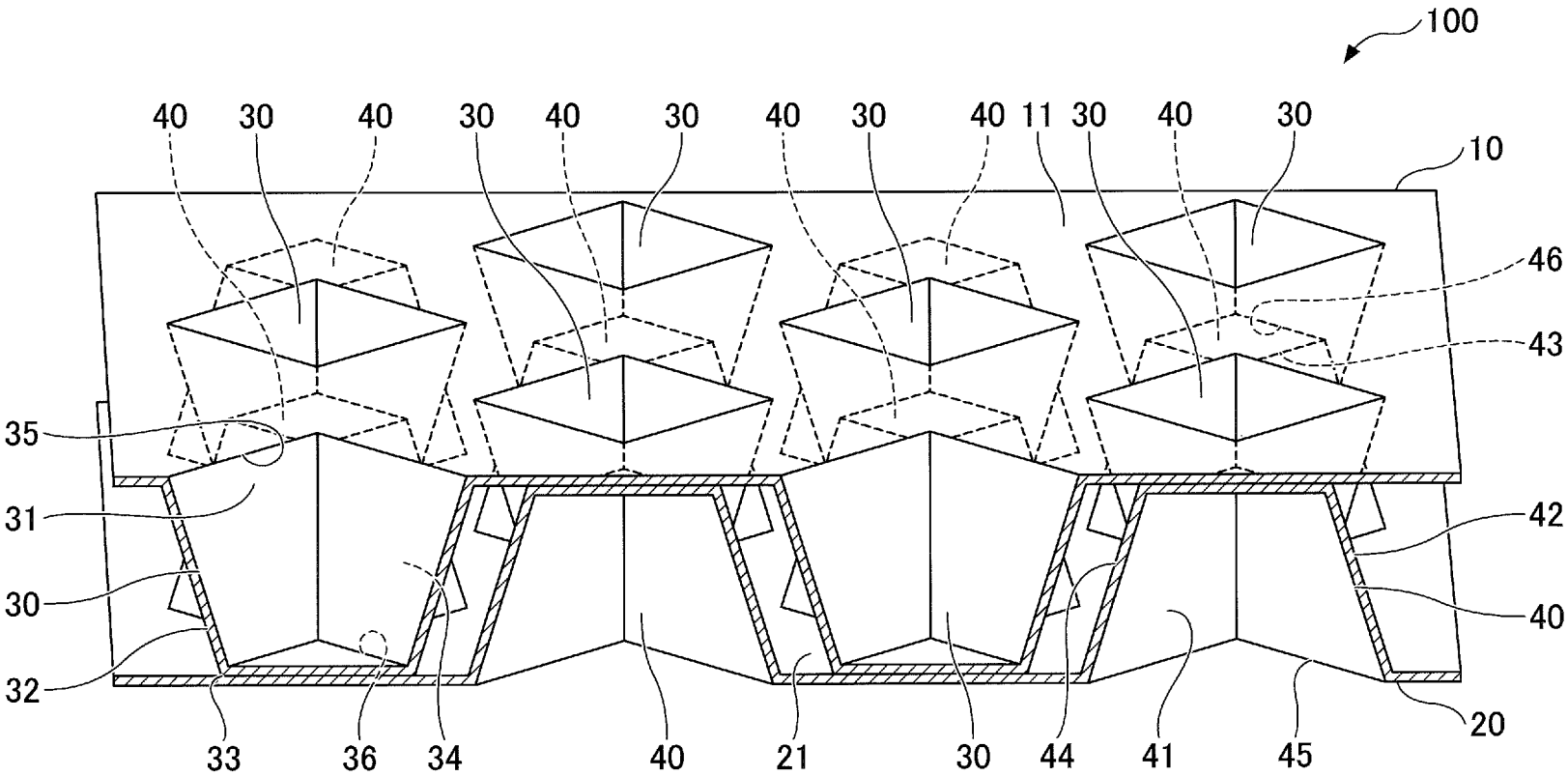
FIG. 4 is an enlarged perspective cross-sectional view of a portion (P2) of FIG. 2.
Figure 5:
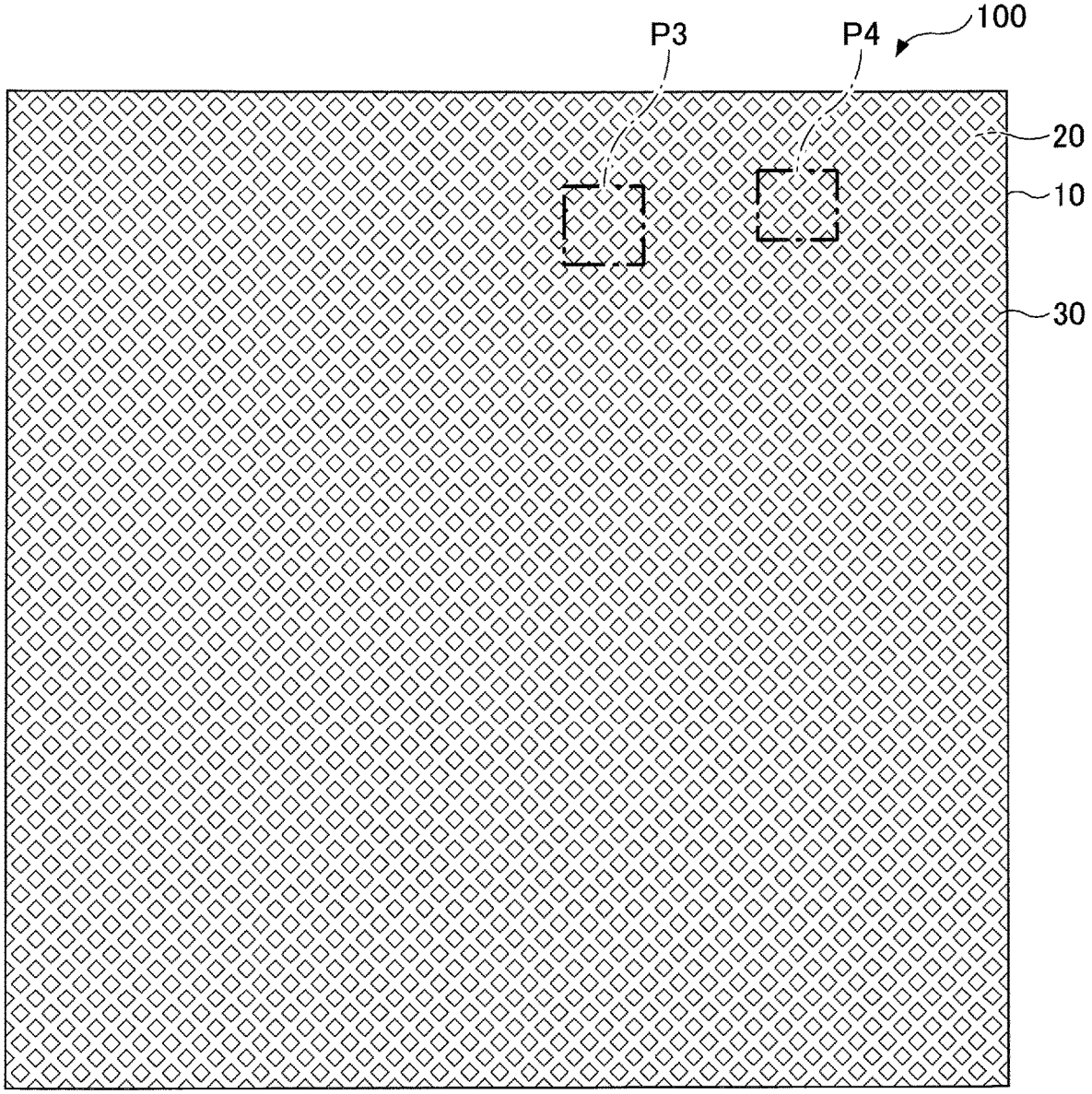
FIG. 5 is a drawing illustrating sheets of crepe paper constituting related-art toilet paper.
Figure 6:
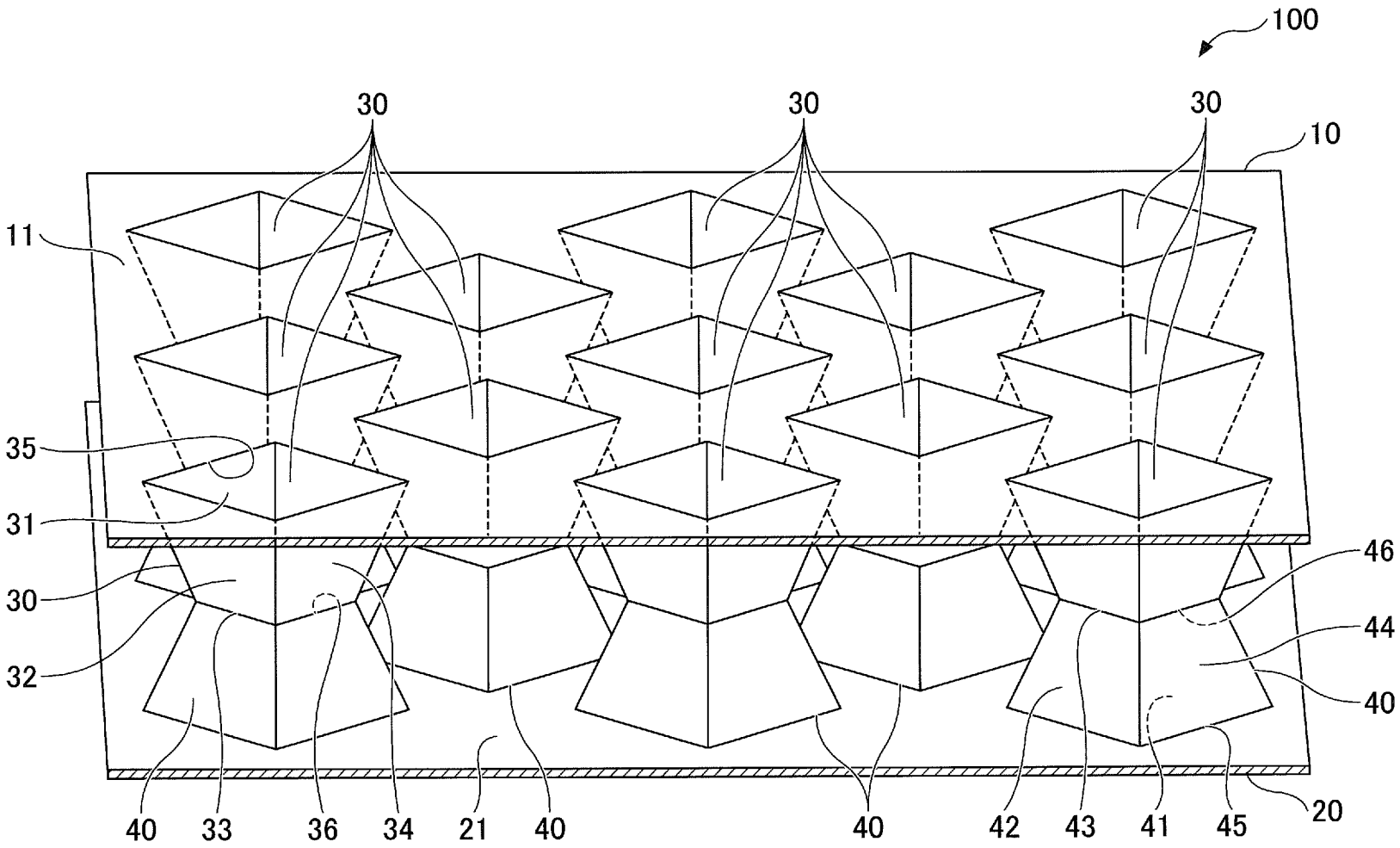
FIG. 6 is an enlarged perspective cross-sectional view of a portion (P3) of FIG. 5.
Figure 7:
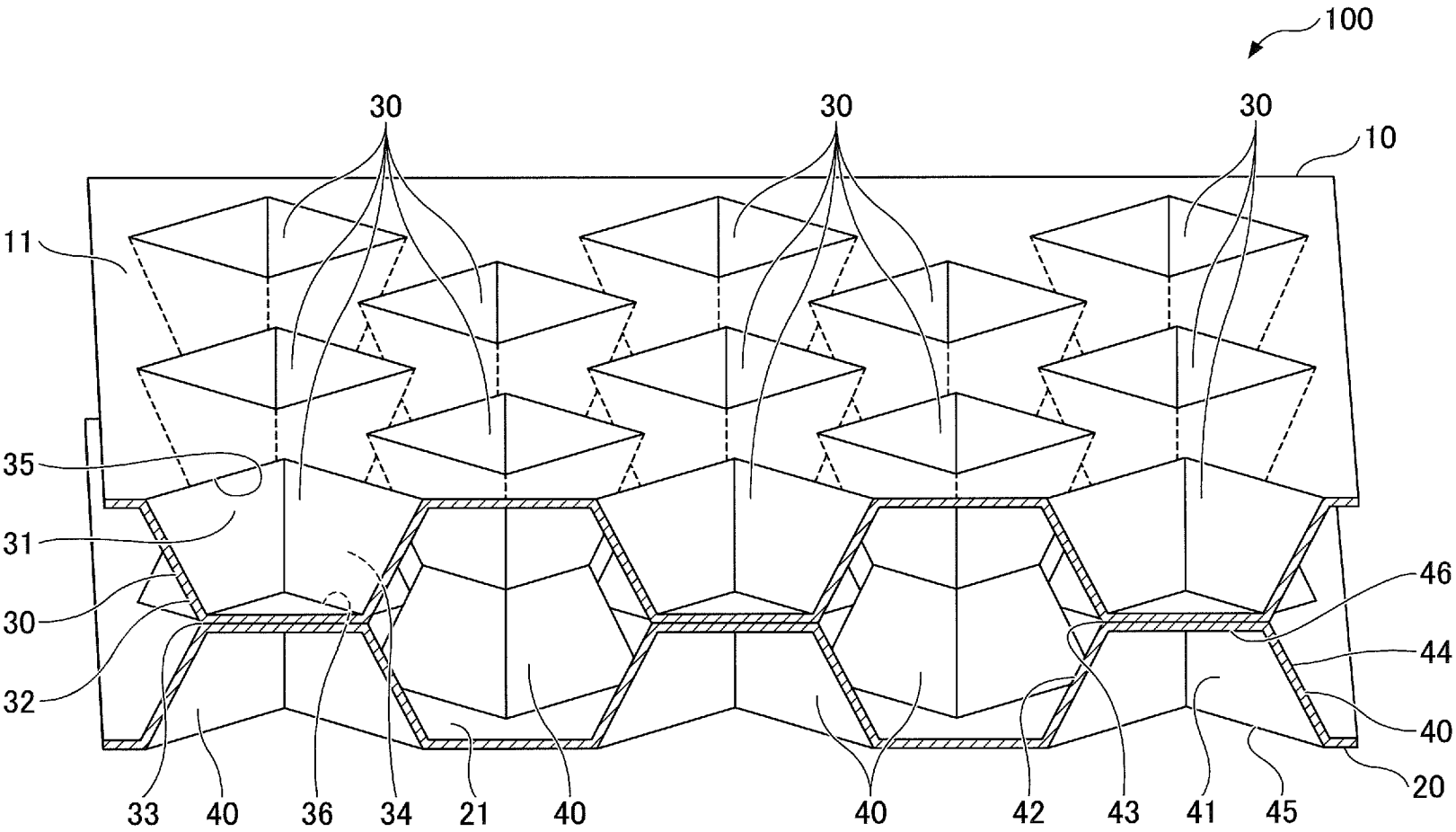
FIG. 7 is an enlarged perspective cross-sectional view of a portion (P4) of FIG. 5.

FIG. 3 is an enlarged perspective cross-sectional view of a portion (P1) of FIG. 2, and FIG. 4 is an enlarged perspective cross-sectional view of a portion (P2) of FIG. 2.

As illustrated in FIGS. 3 and 4, the crepe paper 10 includes embossments 30 and a non-embossed part 11. The non-embossed part 11 is a portion of the crepe paper 10 that is surrounded by the embossments 30 and where the embossments 30 are not formed.

Each embossment 30 is comprised of an embossed recess 31 and an embossed protrusion 32 corresponding to the embossed recess 31. Multiple embossed recesses 31 and multiple embossed protrusions 32 are formed on the front side and the back side of the crepe paper 10. The embossments 30, the embossed recesses 31, and the embossed protrusions 32 are examples of embossments, embossed recesses, and embossed protrusions formed on one of two sheets constituting toilet paper of the present invention.

Each of an opening 35 of the embossed recess 31, a bottom 36 of the embossed recess 31, and a top part 33 of the embossed protrusion 32 has a quadrangular shape in plan view (see FIGS. 2-4). Also, the quadrangular shape of the opening 35 of the embossed recess 31 and the quadrangular shape of the top part 33 of the embossed protrusion 32 are similar to each other.

The top part 33 of the embossed protrusion 32 corresponds to the bottom 36 of the embossed recess 31. Thus, the embossed protrusion 32 has the shape of a truncated quadrangular pyramid. However, the shape of the embossed protrusion 32 is not limited to the truncated quadrangular pyramid. For example, the embossed protrusion 32 may be shaped like a truncated triangular pyramid or a truncated cone.

The embossed recesses 31 are formed as recesses on one side of the crepe paper 10 by pressing a protrusion embossing roller (not shown) against the crepe paper 10 according to an embossing method such as a steel rubber method. On the other hand, the embossed protrusions 32 are formed on the other side of the crepe paper 10 as protrusions corresponding to the embossed recesses 31.

The crepe paper 20 includes embossments 40 and a non-embossed part 21. The non-embossed part 21 is a portion of the crepe paper 20 that is surrounded by the embossments 40 and where the embossments 40 are not formed.

As illustrated in FIGS. 3 and 4, each embossment 40 is comprised of an embossed recess 41 and an embossed protrusion 42 corresponding to the embossed recess 41. Multiple embossed recesses 41 and multiple embossed protrusions 42 are formed on the front side and the back side of the crepe paper 20. The embossments 40, the embossed recesses 41, and the embossed protrusions 42 are examples of embossments, embossed recesses, and embossed protrusions formed on the other one of two sheets constituting toilet paper of the present invention.

Each of an opening 45 of the embossed recess 41, a bottom 46 of the embossed recess 41, and a top part 43 of the embossed protrusion 42 has a quadrangular shape in plan view (see FIGS. 2-4). Also, the quadrangular shape of the opening 45 of the embossed recess 41 and the quadrangular shape of the top part 43 of the embossed protrusion 42 are similar to each other.

The top part 43 of the embossed protrusion 42 corresponds to the bottom 46 of the embossed recess 41. Thus, the embossed protrusion 42 has the shape of a truncated quadrangular pyramid. However, the shape of the embossed protrusion 42 is not limited to the truncated quadrangular pyramid. For example, the embossed protrusion 42 may be shaped like a truncated triangular pyramid or a truncated cone.

The embossed recesses 41 are formed on one side of the crepe paper 20 as recesses by pressing a protrusion embossing roller (not shown) against the crepe paper 20 according to an embossing method such as a steel rubber method. On the other hand, the embossed protrusions 42 are formed on the other side of the crepe paper 20 as protrusions corresponding to the embossed recesses 41.

In the toilet paper 100 of the present embodiment, the crepe paper 10 having the embossments 30 and the crepe paper 20 having the embossments 40 are joined together such that a surface of the crepe paper 10 having the embossed protrusions 32 and a surface of the crepe paper 20 having the embossed protrusions 42 are disposed to face each other in a nested manner. Specifically, as illustrated in FIGS. 2 through 4, the embossed protrusions 32 of the crepe paper 10 are disposed to face the non-embossed part 21 (a portion where no embossed protrusion 42 is formed) of the crepe paper 20. On the other hand, the embossed protrusions 42 of the crepe paper 20 are disposed to face the non-embossed part 11 (a portion where no embossed protrusion 32 is formed) of the crepe paper 10.

The top parts 43 of the embossed protrusions 42 of the crepe paper 20 are bonded to the non-embossed part 11 of the crepe paper 10 with an adhesive (not shown) such as glue. Bonding the top parts 43 of the embossed protrusions 42 of the crepe paper 20 to the non-embossed part 11 of the crepe paper 10 makes it possible to arrange bonded portions between the crepe paper 10 and the crepe paper 20 on one (the crepe paper 10) of two sheets of crepe paper in a balanced manner. This configuration makes it possible to decrease the bonded portions between the crepe paper 10 and the crepe paper 20 that tend to become hard and to disperse the bonded portions between the crepe paper 10 and the crepe paper 20.

As the adhesive, any known adhesive used for toilet paper having a laminated structure may be used. Examples of major components of such an adhesive include polyvinyl alcohol, starch, modified starch, and carboxymethylcellulose.

In the present embodiment, the top parts 33 of the embossed protrusions 32 of the crepe paper 10 are not bonded to the non-embossed part 21 of the crepe paper 20. However, instead of bonding the top parts 43 of the embossed protrusions 42 of the crepe paper 20 to the non-embossed part 11 of the crepe paper 10, the top parts 33 of the embossed protrusions 32 of the crepe paper 10 may be bonded to the non-embossed part 21 of the crepe paper 20. Also, in addition to bonding the top parts 43 of the embossed protrusions 42 of the crepe paper 20 to the non-embossed part 11 of the crepe paper 10, the top parts 33 of the embossed protrusions 32 of the crepe paper 10 may be bonded to the non-embossed part 21 of the crepe paper 20.

In the toilet paper 100 illustrated in FIGS. 1 through 4, the area of each of the top parts 33 of the embossed protrusions 32 facing the crepe paper 20 and the top parts 43 of the embossed protrusions 42 facing the crepe paper 10 is between 0.8 $mm^2$ and 1.5 $mm^2$, is preferably between 0.9 $mm^2$ and 1.4 $mm^2$, and is more preferably between 1.0 $mm^2$ and 1.3 $mm^2$.

The area of the top part 33 of the embossed protrusion 32 indicates the area of the top part 33 of each embossed protrusion 32. Also, the area of the top part 43 of the embossed protrusion 42 indicates the area of the top part 43 of each embossed protrusion 42. Hereafter, the area of the top part of each embossed protrusion may be referred to as an individual area.

If the individual area of the embossed protrusion 32 and the embossed protrusion 42 is less than 0.8 $mm^2$, the toilet paper 100 may not have sufficient strength in the thickness direction. If the individual area of the embossed protrusion 32 and the embossed protrusion 42 is greater than 1.5 $mm^2$, each of the embossed protrusion 32 and the embossed protrusion itself becomes more likely to be flattened and the strength of the toilet paper 100 in the thickness direction may be reduced.

In the toilet paper 100 illustrated in FIGS. 1 through 4, each of the area percentage of the top parts 33 of the embossed protrusions 32 facing the crepe paper 20 and the area percentage of the top parts 43 of the embossed protrusions 42 facing the crepe paper 10 is between 5% and 10%, is preferably between 7% and 10%, and is more preferably between 8% and 10%.

The area percentage of the top parts 33 of the embossed protrusions 32 indicates the percentage of the area of the top parts 33 of the embossed protrusions 32 in the area of the embossed region of the crepe paper 10 (or the percentage of the area of the embossed protrusions 32 in the crepe paper 10). The area percentage of the top parts 43 of the embossed protrusions 42 indicates the percentage of the area of the top parts 43 of the embossed protrusions 42 in the area of the embossed region of the crepe paper 20 (or the percentage of the area of the embossed protrusions 42 in the crepe paper 20). In the present application, the area percentage of the top parts of the embossed protrusions may be referred to as a gluing area percentage.

If both of the area percentage of the embossed protrusions 32 and the area percentage of the embossed protrusions 42 are less than 5%, the toilet paper 100 may not have sufficient strength in the thickness direction. Also, if the area percentage of the embossed protrusions 32 and the area percentage of the embossed protrusions 42 are greater than 10%, the non-embossment space formed between the crepe paper 10 and the crepe paper 20 may become small. Also in this case, the embossed protrusions 32 and the embossed protrusions 42 may interfere with each other.

In present embodiment, as illustrated in FIGS. 3 and 4, the crepe paper 10 and the crepe paper 20 are joined together such that a surface having the embossed protrusions 32 and a surface having the embossed protrusions 42 are disposed to face each other in a nested manner, the area of each of the top parts 33 of the embossed protrusions 32 and the top parts 43 of the embossed protrusions 42 is between 0.8 $mm^2$ and 1.5 $mm^2$, and each of the area percentage of the top parts 33 of the embossed protrusions 32 and the area percentage of the top parts 43 of the embossed protrusions 42 is between 5% and 10%.

With the above configuration of the present embodiment, the crepe paper 10 is supported by the embossed protrusions 42 of the crepe paper 20, and the crepe paper 20 is supported by the embossed protrusions 32 of the crepe paper 10. Thus, this configuration makes it possible to increase the strength of the toilet paper 100 in the thickness direction.

Also, the present embodiment makes it possible to prevent the embossed protrusions 32 of the crepe paper 10 and the embossed protrusions 42 of the crepe paper 20 from interfering with each other, and makes it possible to form a non-embossment space (a space where the embossed protrusions 32 and 42 are not present) between the crepe paper 10 and the crepe paper 20. Thus, the present embodiment makes it possible to provide the toilet paper 100 that is bulky and less likely to be flattened.

Also, the present embodiment makes it possible to reduce the bonding area (or gluing area) between the embossed protrusions 32 and the crepe paper 20 and between the embossed protrusions 42 and the crepe paper 10. Accordingly, the present embodiment makes it possible to suppress the toilet paper 100 from becoming hard due to the bonded portions of the crepe paper 10 and the crepe paper 20.

Also, in the present embodiment, the height of the embossed protrusions 32 and 42 is preferably between 1.0 mm and 1.7 mm, more preferably between 1.1 mm and 1.5 mm, and further preferably between 1.2 mm and 1.4 mm. The height of the embossed protrusion 32 is the distance from the surface of the crepe paper 10 on which the embossed protrusion 32 is formed to the top part 33 of the embossed protrusion 32, and the height of the embossed protrusion 42 is the distance from the surface of the crepe paper 20 on which the embossed protrusion is formed to the top part 43 of the embossed protrusion 42.

In the present embodiment, the height of the embossed protrusions 32 and 42 is set within the above range so that the non-embossment space formed between the sheets can be increased while maintaining the strength in the thickness direction of the toilet paper 100. Accordingly, the toilet paper 100 becomes bulkier and more unlikely to be flattened.

In present embodiment, as illustrated in FIGS. 3 and 4, a side surface 34 of the embossed protrusion 32 of the crepe paper 10 is inclined such that the area of the top part 33 of the embossed protrusion 32 becomes less than the area of the opening 35 of the embossed recess 31. That is, the embossed protrusion 32 tapers from the surface of the crepe paper 10 on which the embossed protrusion 32 is formed toward the top part 33 (or the bottom 36) of the embossed protrusion 32.

Also, a side surface 44 of the embossed protrusion 42 of the crepe paper 20 is inclined such that the area of the top part 43 of the embossed protrusion 42 becomes less than the area of the opening of the embossed recess 41. That is, the embossed protrusion 42 tapers from the surface of the crepe paper 20 on which the embossed protrusion 42 is formed toward the top part 43 (or the bottom 46) of the embossed protrusion 42.

The above configuration of the present embodiment makes it possible to more reliably prevent the embossed protrusions 32 and the embossed protrusions 42 from interfering with each other between the crepe paper 10 and the crepe paper 20, and makes it possible to increase the non-embossment space formed between the crepe paper 10 and the crepe paper 20. Accordingly, the toilet paper 100 becomes bulkier and more unlikely to be flattened.

Also, the embossed protrusion 32 tapers from the surface of the crepe paper 10 on which the embossed protrusion 32 is formed toward the top part 33 (or the bottom 36) of the embossed protrusion 32. With this configuration, even when the top parts 33 of the embossed protrusions 32 of the crepe paper 10 are bonded to the non-embossed part 21 of the crepe paper 20, the bonding area between the embossed protrusions 32 and the crepe paper 20 can be reduced. This in turn makes it possible to suppress the toilet paper 100 from becoming hard due to the bonded portions between the crepe paper 10 and the crepe paper 20.

Also, the embossed protrusion 42 tapers from the surface of the crepe paper 20 on which the embossed protrusion 42 is formed toward the top part 43 (or the bottom 46) of the embossed protrusion 42. With this configuration, even when the top parts 43 of the embossed protrusions 42 of the crepe paper 20 are bonded to the non-embossed part 11 of the crepe paper 10, the bonding area between the embossed protrusions 42 and the crepe paper 10 can be reduced. This in turn makes it possible to suppress the toilet paper 100 from becoming hard due to the bonded portions between the crepe paper 10 and the crepe paper 20.

Each of the inclination angle of the side surface 34 of the embossed protrusion 32 and the inclination angle of the side surface 44 of the embossed protrusion 42 is preferably between 60 degrees and 80 degrees, more preferably between 63 degrees and 77 degrees, and further preferably between 65 degrees and 75 degrees.

Here, the inclination angle of the side surface 34 of the embossed protrusion 32 is the angle between the surface of the crepe paper 10 on which the embossed protrusion 32 is formed and the side surface 34 of the embossed protrusion 32. Also, the inclination angle of the side surface 44 of the embossed protrusion 42 is the angle between the surface of the crepe paper 20 on which the embossed protrusion 42 is formed and the side surface 44 of the embossed protrusion 42.

Setting the inclination angle of the side surfaces 34 and 44 of the embossed protrusions 32 and 42 at a value between 60 degrees and 80 degrees makes it possible to further suppress the toilet paper from becoming hard due to bonded portions while maintaining the bulk and the anti-flattening property of the toilet paper.

Under a load of a 50 $gf/cm^2$, the initial thickness of the toilet paper 100 is preferably greater than or equal to 0.7 mm, and the compression ratio of the toilet paper 100 is preferably less than or equal to 60%. Here, the initial thickness under the load of 50 gf/cm$^2$ indicates the thickness of the toilet paper immediately before the load of 50 gf/cm$^2$ is applied to the toilet paper in the thickness direction.

Also, the compression ratio under the load of 50 gf/cm$^2$ is calculated according to a formula below based on the thickness (thickness under load) of the toilet paper 100 when the load of 50 gf/cm$^2$ is applied to the toilet paper 100 in the thickness direction and the initial thickness.

Compression ratio (%)=(initial thickness−thickness under load)/initial thickness×100

Here, the load of 50 gf/cm$^2$ is a pressure that is supposed to be applied when toilet paper is used (for example, for wiping). Setting the physical characteristics of the toilet paper 100 as described above makes it possible to reliably obtain bulky toilet paper that is less likely to be flattened.

Also, the compression strength of the toilet paper 100 under a load of 500 gf/cm$^2$ is preferably greater than or equal to 4.5 gf·cm/cm$^2$. Here, the compression strength under the load of 500 gf/cm$^2$ corresponds to compression energy (gf·cm/cm$^2$) generated when the load of 500 gf/cm$^2$ is applied to the toilet paper 100 in the thickness direction. The load of 500 gf/cm$^2$ is set as an excessive pressure exceeding a pressure that is supposed to be applied when toilet paper is used.

Setting the physical characteristics of the toilet paper as described above makes it possible to further increase the strength of the toilet paper. This in turn makes it possible to provide durable toilet paper while maintaining the bulk and the anti-flattening property of the toilet paper. When the compression strength under a load of 500 gf/cm$^2$ is greater than or equal to 4.5 gf·cm/cm$^2$, the toilet paper is readily compressed. Therefore, the toilet paper 100 of the present embodiment becomes soft.

EXAMPLES

The present embodiment is further described below using examples. However, the present invention is not limited to those examples. The measurement and evaluation of examples and comparative examples were performed as described below.

[Basis Weight (Base Paper and Product)]

The basis weights (paper weights in gsm) (g/m$^2$) of crepe paper (base paper) and products of the toilet paper 100 used in tests were measured. The basis weights (paper weights in gsm) (g/m$^2$) were calculated according to JIS P 8124 (1998).

[Thickness (Base Paper)]

The thickness (μm/sheet) of base paper was measured. After a specimen of base paper cut into a 50 cm×50 cm size was sufficiently humidified under conditions specified by JIS P 8111 (1998), the thickness of the specimen was measured under the same conditions using a dial thickness gauge "PEACOCK TYPE G" (OZAKI MFG. CO., LTD). In an actual measurement procedure, after confirming that there is no dust or dirt between a plunger and a measurement table, the plunger is lowered onto the measurement table, and the scale of the dial thickness gauge is moved to adjust the zero point. Next, the plunger is raised, and the specimen is placed on the test table. Then, the plunger is slowly lowered, and the gauge is read. At this step, the plunger is simply placed on the specimen. The plunger has a circular end part that is made of a metal and has a diameter of 10 mm. The plunger is placed on the specimen such that a flat surface of the circular end part perpendicularly contacts the paper surface. When the thickness is 120 μm, the load applied to measure the thickness is about 70 gf. An average of ten measurements is used as the measurement of the thickness.

[Thickness (Product)]

The thickness of each product was measured (The thickness is measured in the state of a product. For example, the thickness of a 2-ply product is measured in the 2-ply state). After a specimen cut into a 12 cm×12 cm size was sufficiently humidified under conditions specified by JIS P 8111 (1998), the thickness of the specimen was measured under the same conditions using a dial thickness gauge "PEACOCK TYPE H" (OZAKI MFG. CO., LTD). In an actual measurement procedure, after confirming that there is no dust or dirt between a plunger and a measurement table, the plunger is lowered onto the measurement table, and the scale of the dial thickness gauge is moved to adjust the zero point. Next, the plunger is raised, and the specimen is placed on the test table. After opening the gauge head to 70 μm by moving the plunger, the lever is released at once, and the gauge is read. The plunger has a circular end part that is made of a metal and has a diameter of 10 mm. The plunger is placed on the specimen such that a flat surface of the circular end part perpendicularly contacts the paper surface. When the thickness is 120 μm, the load applied to measure the thickness is about 70 gf. An average of ten measurements is used as the measurement of the thickness.

[Compression Test]

Compression tests were performed on the toilet paper 100. In the compression test, a specimen cut into a 12 cm×12 cm size is prepared (The test is performed on toilet paper in the state of a product. For example, when the specimen is a 2-ply product, the test is performed on the specimen in the 2-ply state). Using a compression tester (KATO TECH CO., LTD., KES-G5), compression energy WC (gf·cm/cm$^2$) when a load of 500 gf/cm$^2$ is applied, an initial thickness $T_0$ (mm) under a load of 50 gf/cm$^2$, and a thickness $T_m$ (mm) after applying the load of 50 gf/cm$^2$ are measured. Also, a compression ratio (%) under the load of 50 gf/cm$^2$ is calculated based on the initial thickness $T_0$ (mm) and the thickness $T_m$ (mm). The measurement conditions are as follows: pressurizer area: 2 cm$^2$, dynamometer: 1 kg, CHECK switch: MES, DEF output sensitivity dial: 2 mm/V, upper limit load: (1) 50 gf/cm$^2$ (SENS: 2, STOROKE SET dial: 5), (2) 500 gf/cm$^2$ (SENS: 10, STOROKE SET dial: 10), SPEED: 0.02 cm/s (SPEED RANGE switch: 0.1, SPED SET switch: 2), CONTROL switch: INT, and STOP switch: OFF.

Here, the compression energy WC is an integral of a compression workload when the specimen is compressed up to the upper limit load. The initial thickness $T_0$ is the thickness of the specimen when the load pressure reaches 0.5 gf/cm$^2$, and the thickness $T_m$ under the load is the thickness of the specimen when the load pressure reaches the upper limit load (50 gf/cm$^2$). Each of the initial thickness $T_0$ and the thickness $T_m$ under the load is obtained by averaging three measurements. The compression ratio (flattening ratio) under the load is calculated based on the initial thickness $T_0$ and the thickness $T_m$ under the load. The compression ratio under the load is calculated using a formula below.

Compression ratio under load (%)=(initial thickness $T_0$−thickness $T_m$ under load)/initial thickness $T_0$×100

When the compression energy under a load of 500 gf/cm$^2$ is high, it indicates that the toilet paper is strong and durable. Also, when the compression energy under a load of 500 gf/cm$^2$ is high, it indicates that the toilet paper is soft and is readily compressed. In this example, when the compression strength under a load of 500 gf/cm$^2$ is greater than or equal to 4.5 gf·cm/cm$^2$, the toilet paper is evaluated as being durable and soft.

Also, when the initial thickness $T_0$ under a load of 50 gf/cm$^2$ is large, it indicates that the toilet paper is bulky. In this example, when the initial thickness $T_0$ under the load of 50 gf/cm$^2$ is greater than or equal to 0.7 mm, the toilet paper is evaluated as being bulky.

Also, when the compression ratio under the load of 50 gf/cm$^2$ is low, it indicates that the toilet paper is not readily flattened in the thickness direction. In this example, when the compression ratio under the load of 50 gf/cm$^2$ is less than or equal to 60%, the toilet paper is evaluated as being not readily flattened.

Example 1

In Example 1, toilet paper was prepared by stacking two sheets of base paper (2-ply crepe paper 10, 20) with a basis weight of 15.3 g/m$^2$ and a thickness of 131 μm in a nested manner (see FIGS. 2 through 4). The embossing conditions were as follows: area of top part of embossed protrusion: 1.2 mm$^2$/each, height of embossed protrusion: 1.4 mm, inclination angle of embossed protrusion: 70 degrees, shape of top part of embossed protrusion: quadrangle, number of embossed protrusions (front, crepe paper 10): 1110/144 cm$^2$; number of embossed protrusions (back, crepe paper 20): 1116/144 cm$^2$; area percentage of top parts of embossed protrusions (percentage of gluing area between non-embossed part 11 of crepe paper 10 and embossed protrusions 42 of crepe paper 20): 9.1%, volume of embossed protrusions (front, crepe paper 10): 3930 mm$^3$, volume of embossed protrusions (back, crepe paper 20): 3930 mm$^3$; volume of non-embossment space (volume of space excluding embossed protrusions): 12000 mm$^3$, and area percentage of non-embossed part: 70.8%. Also, in Example 1, as a toilet paper product, the basis weight was 14.1 g/m$^2$ and the thickness was 340 μm.

The conditions and results of Example 1 are indicated in Table 1.

Example 2

The embossing conditions in Example 2 were substantially the same as those in Example 1 except for the following conditions: number of embossed protrusions (front, crepe paper 10): 1109/144 cm$^2$; number of embossed protrusions (back, crepe paper 20): 1110/144 cm$^2$; area percentage of top parts of embossed protrusions (percentage of gluing area between non-embossed part 11 of crepe paper 10 and embossed protrusions 42 of crepe paper 20): 9.0%, volume of embossed protrusions (front, crepe paper 10): 3877 mm$^3$, volume of embossed protrusions (back, crepe paper 20): 3879 mm$^3$; volume of non-embossment space: 12404 mm$^3$, area percentage of non-embossed part: 70.4%, basis weight of toilet paper product: 14.1 g/m$^2$, and thickness of toilet paper product: 332 μm. The conditions and results of Example 2 are indicated in Table 1.

Example 3

The embossing conditions in Example 3 were substantially the same as those in Example 1 except for the following conditions: number of embossed protrusions (front, crepe paper 10): 1013/144 cm$^2$; number of embossed protrusions (back, crepe paper 20): 1012/144 cm$^2$; area percentage of top parts of embossed protrusions (percentage of gluing area between non-embossed part 11 of crepe paper 10 and embossed protrusions 42 of crepe paper 20): 8.0%, volume of embossed protrusions (front, crepe paper 10): 3461 mm$^3$, volume of embossed protrusions (back, crepe paper 20): 3461 mm$^3$; volume of non-embossment space: 13238 mm$^3$, area percentage of non-embossed part: 72.1%, basis weight of toilet paper product: 14.2 g/m$^2$, and thickness of toilet paper product: 404 g m. The conditions and results of Example 3 are indicated in Table 1.

Example 4

The embossing conditions in Example 4 were substantially the same as those in Example 1 except for the following conditions: number of embossed protrusions (front, crepe paper 10): 1201/144 cm$^2$; number of embossed protrusions (back, crepe paper 20): 1200/144 cm$^2$; area percentage of top parts of embossed protrusions (percentage of gluing area between non-embossed part 11 of crepe paper 10 and embossed protrusions 42 of crepe paper 20): 10.0%, volume of embossed protrusions (front, crepe paper 10): 4306 mm$^3$, volume of embossed protrusions (back, crepe paper 20): 4302 mm$^3$; volume of non-embossment space: 11552 mm$^3$, area percentage of non-embossed part: 65.4%, basis weight of toilet paper product: 14.1 g/m$^2$, and thickness of toilet paper product: 427 μm. The conditions and results of Example 4 are indicated in Table 1.

Comparative Example 1

The embossing conditions in Comparative Example 1 were substantially the same as those in Example 1 except for the following conditions: two sheets of base paper (crepe paper 10, 20) were stacked in a tip-to-tip manner, area of top part of embossed protrusion: 1.0 mm$^2$/each, height of embossed protrusion: 1.2 mm, number of embossed protrusions (front, crepe paper 10): 2109/144 cm$^2$; number of embossed protrusions (back, crepe paper 20): 2107/144 cm$^2$; percentage of gluing area between embossed protrusions 32 of crepe paper 10 and embossed protrusions 42 of crepe paper 20: 14.6%, volume of embossed protrusions (front, crepe paper 10): 5426 mm$^3$, volume of embossed protrusions (back, crepe paper 20): 6432 mm$^3$; area percentage of non-embossed part: 48.6%, basis weight of toilet paper product: 14.0 g/m$^2$, and thickness of toilet paper product: 265 μm. The conditions and results of Comparative Example 1 are indicated in Table 1.

REFERENCE EXAMPLE 1

In Reference Example 1, toilet paper with a design-laminated structure was prepared by stacking two sheets of base paper (2-ply crepe paper) with a basis weight of 15.5 g/m$^2$ and a thickness of 133 μm. The area of the top part of the embossed protrusion was 1.3 mm$^2$/each in the front embossment and 0.3 mm$^2$/each in the back embossment. The height of the embossed protrusion was 1.4 mm in the front embossment and 0.5 mm in the back embossment. The inclination angle of the embossed protrusion was 80 degrees, and the top part of the embossed protrusion had a circular shape and a floral design. The percentage of the gluing area between the sheets of crepe paper (the area percentage of the top parts of the embossed protrusions) was 7.1%. Also, in Reference Example 1, as a toilet paper product, the basis weight was 15.1 g/m$^2$ and the thickness was 199 μm. The conditions and results of Reference Example 1 are indicated in Table 1.

TABLE 1

| | | | EXAMPLE 1 | EXAMPLE 2 | EXAMPLE 3 | EXAMPLE 4 |
|---|---|---|---|---|---|---|
| BASE PAPER | BASIS WEIGHT | ($g/m^2$) | 15.3 | 15.3 | 15.3 | 15.3 |
| | THICKNESS | (μm) | 131 | 131 | 131 | 131 |
| EMBOSSING CONDITIONS | LAMINATED STRUCTURE | | nested | nested | nested | nested |
| | NUMBER OF PLIES | (NUMBER) | 2 | 2 | 2 | 2 |
| | AREA OF TOP PART OF EMBOSSED PROTRUSION | ($mm^2$/EACH) | 1.2 | 1.2 | 1.2 | 1.2 |
| | HEIGHT OF EMBOSSED PROTRUSION | (mm) | 1.4 | 1.4 | 1.4 | 1.4 |
| | INCLINATION ANGLE OF EMBOSSED PROTRUSION | (°) | 70 | 70 | 70 | 70 |
| | SHAPE OF TOP PART OF EMBOSSED PROTRUSION | | QUAD-RANGLE | QUAD-RANGLE | QUAD-RANGLE | QUAD-RANGLE |
| | NUMBER OF EMBOSSMENTS: FRONT | (NUMBER/144 $cm^2$) | 1110 | 1109 | 1013 | 1201 |
| | NUMBER OF EMBOSSMENTS: BACK | (NUMBER/144 $cm^2$) | 1116 | 1110 | 1012 | 1200 |
| | AREA PERCENTAGE OF TOP PARTS OF EMBOSSED PROTRUSIONS (GLUING AREA PERCENTAGE) | (%) | 9.1 | 9.0 | 8.0 | 10.0 |
| | VOLUME OF EMBOSSED PROTRUSIONS: FRONT | ($mm^3$) | 3930 | 3877 | 3461 | 4306 |
| | VOLUME OF EMBOSSED PROTRUSIONS: BACK | ($mm^3$) | 3930 | 3879 | 3461 | 4302 |
| | VOLUME OF NON-EMBOSSMENT SPACE (VOLUME OF SPACE EXCLUDING EMBOSSED PROTRUSIONS) | ($mm^3$) | 12000 | 12404 | 13238 | 11552 |
| | AREA PERCENTAGE OF NON-EMBOSSED PART | (%) | 70.8 | 70.4 | 72.1 | 65.4 |
| PRODUCT | BASIS WEIGHT | ($g/m^2$) | 14.1 | 14.1 | 14.2 | 14.1 |
| | THICKNESS | (μm) | 340 | 332 | 404 | 427 |
| COMPRESSION TEST (LOAD: 500 $gf/cm^2$) | COMPRESSION ENERGY WC | (gf · $cm/cm^2$) | 6.48 | 5.52 | 4.59 | 4.75 |
| COMPRESSION TEST (LOAD: 50 $gf/cm^2$) | INITIAL THICKNESS T0 | (mm) | 0.72 | 0.73 | 0.71 | 0.74 |
| | THICKNESS AFTER APPLYING LOAD Tm | (mm) | 0.40 | 0.41 | 0.38 | 0.43 |
| | COMPRESSION RATIO (T0 − Tm)/T0 | (%) | 43.8 | 43.4 | 46.5 | 41.9 |

| | | | COMPARATIVE EXAMPLE 1 | REFERENCE EXAMPLE 1 |
|---|---|---|---|---|
| BASE PAPER | BASIS WEIGHT | ($g/m^2$) | 15.3 | 15.5 |
| | THICKNESS | (μm) | 131 | 133 |
| EMBOSSING CONDITIONS | LAMINATED STRUCTURE | | tip to tip | DESIGN LAMINATE |
| | NUMBER OF PLIES | (NUMBER) | 2 | 2 |
| | AREA OF TOP PART OF EMBOSSED PROTRUSION | ($mm^2$/EACH) | 1.0 | FRONT EMBOSSMENT 1.3 BACK EMBOSSMENT 0.3 |
| | HEIGHT OF EMBOSSED PROTRUSION | (mm) | 1.2 | FRONT EMBOSSMENT 1.4 BACK EMBOSSMENT 0.5 |
| | INCLINATION ANGLE OF EMBOSSED PROTRUSION | (°) | 70 | 80 |
| | SHAPE OF TOP PART OF EMBOSSED PROTRUSION | | QUAD-RANGLE | CIRCULAR SHAPE, FLORAL DESIGN |
| | NUMBER OF EMBOSSMENTS: FRONT | (NUMBER/144 $cm^2$) | 2109 | — |
| | NUMBER OF EMBOSSMENTS: BACK | (NUMBER/144 $cm^2$) | 2107 | — |
| | AREA PERCENTAGE OF TOP PARTS OF EMBOSSED PROTRUSIONS (GLUING AREA PERCENTAGE) | (%) | 14.6 | 7.1 |
| | VOLUME OF EMBOSSED PROTRUSIONS: FRONT | ($mm^3$) | 5426 | — |
| | VOLUME OF EMBOSSED PROTRUSIONS: BACK | ($mm^3$) | 5421 | — |
| | VOLUME OF NON-EMBOSSMENT SPACE (VOLUME OF SPACE EXCLUDING EMBOSSED PROTRUSIONS) | ($mm^3$) | 6432 | — |

TABLE 1-continued

| | | | | |
|---|---|---|---|---|
| | AREA PERCENTAGE OF NON-EMBOSSED PART | (%) | 48.6 | — |
| PRODUCT | BASIS WEIGHT | ($g/m^2$) | 14.0 | 15.1 |
| | THICKNESS | (μm) | 265 | 199 |
| COMPRESSION TEST (LOAD: 500 $gf/cm^2$) | COMPRESSION ENERGY WC | (gf · $cm/cm^2$) | 4.14 | 3.57 |
| COMPRESSION TEST (LOAD: 50 $gf/cm^2$) | INITIAL THICKNESS T0 | (mm) | 0.72 | 0.49 |
| | THICKNESS AFTER APPLYING LOAD Tm | (mm) | 0.25 | 0.25 |
| | COMPRESSION RATIO (T0 − Tm)/T0 | (%) | 65.2 | 49.0 |

As indicated in Table 1, in Examples 1-4, the initial thickness under a load of 50 $gf/cm^2$ is greater than or equal to 0.7 mm, and the compression ratio under the load of 50 $gf/cm^2$ is less than or equal to 60%. Also, the compression energy under a load of 500 $gf/cm^2$ is greater than or equal to 4.5 $gf \cdot cm/cm^2$.

On the other hand, in Comparative Example 1, although the initial thickness under the load of 50 $gf/cm^2$ is greater than or equal to 0.7 mm, the compression ratio is greater than 60%. Also, the compression energy under a load of 500 $gf/cm^2$ is less than 4.5 $gf \cdot cm/cm^2$.

In Reference Example 1, the initial thickness under a load of 50 $gf/cm^2$ is less than 0.7 mm, the compression ratio is less than or equal to 60%, and the compression energy under a load of 500 $gf/cm^2$ is less than 4.5 $gf \cdot cm/cm^2$.

These results indicate that the related-art toilet paper with a tip-to-tip structure (Comparative Example 1) can be made bulky but is easily flattened. The above results also indicate that the related-art toilet paper with a design-laminated structure (Reference Example 1) is less likely to be flattened but cannot be made bulky. Also, the related-art toilet paper (Comparative Example 1 and Reference Example 1) does not have sufficient strength and cannot be readily compressed.

On the other hand, in the toilet paper of the present embodiment (Examples 1-4), the crepe paper 10 and the crepe paper 20 are joined together such that a surface having the embossed protrusions 32 and a surface having the embossed protrusions 42 are disposed to face each other in a nested manner, the area of the top parts of the embossed protrusions 42/32 facing the crepe paper 10/20 is between 0.8 $mm^2$ and 1.5 $mm^2$, and the area percentage of the top parts 33/43 of the embossed protrusions 32/42 facing the crepe paper 20/10 is between 5% and 10%. The above results indicate that this configuration makes it possible to provide bulky toilet paper that is less likely to be flattened. Further, the toilet paper of the present embodiment (Examples 1 to 4) has a high strength and can be easily compressed. Thus, the toilet paper of the present embodiment is durable and soft.

Preferred embodiments of the present invention are described above. However, the present invention is not limited to the specifically disclosed embodiments, and variations and modifications may be made without departing from the scope of the present invention.

The present international application claims priority to Japanese Patent Application No. 2017-128580, filed on Jun. 30, 2017, the entire contents of which are hereby incorporated herein by reference.

EXPLANATION OF REFERENCE NUMERALS

100 Toilet paper
10 Crepe paper
20 Crepe paper
30 Embossment
31 Embossed recess
32 Embossed protrusion
33 Top part
34 Side surface
35 Opening
40 Embossment
41 Embossed recess
42 Embossed protrusion
43 Top part
44 Side surface
45 Opening

The invention claimed is:

1. Toilet paper, comprising:

at least two sheets on which embossments are formed, the two sheets being crepe paper, the embossments including embossed protrusions, each embossed protrusion having a shape of a truncated quadrangular pyramid, and the sheets being joined, together in a nested manner such that the embossed protrusion formed on one of the sheets faces a non-embossed part of another one of the sheets where no embossment is formed, wherein an area of a top part of the embossed protrusion of each of the embossments is between 0.8 $mm^2$ and 1.5 $mm^2$; and an area percentage of top parts of the embossed protrusions of the embossments is between 5% and 10%.

2. The toilet paper as claimed in claim 1, wherein a height of the embossed protrusion is between 1.0 mm and 1.7 mm.

3. The toilet paper as claimed in claim 1, wherein a side surface of the embossed protrusion is inclined from corresponding one of the sheets toward the top part such that the area of the top part of the embossed protrusion becomes less than an area of an opening of an embossed recess corresponding to the embossed protrusion.

4. The toilet paper as claimed in claim 3, wherein an inclination angle of the side surface of the embossed protrusion is between 60 degrees and 80 degrees.

5. The toilet paper as claimed in claim 1, wherein under a load of 50 $gf/cm^2$, an initial thickness of the toilet paper is greater than or equal to 0.7 mm and a compression ratio of the toilet paper represented by a formula "(the initial thickness of the toilet paper−a thickness of the toilet paper under the load)/the initial thickness" is less than or equal to 60%.

6. The toilet paper as claimed in claim 1, wherein a compression strength of the toilet paper under a load of 500 $gf/cm^2$ is greater than or equal to 4.5 $gf \cdot cm/cm^2$.

* * * * *